US009682553B2

(12) United States Patent
Nishida et al.

(10) Patent No.: US 9,682,553 B2
(45) Date of Patent: Jun. 20, 2017

(54) INKJET HEAD HAVING A PLURALITY OF LID MEMBERS CONNECTED TO NOZZLES AND AN INKJET APPARATUS HAVING THE INKJET HEAD

(71) Applicants: KABUSHIKI KAISHA TOSHIBA, Tokyo (JP); TOSHIBA TEC KABUSHIKI KAISHA, Tokyo (JP)

(72) Inventors: Hideaki Nishida, Izunokuni Shizuoka (JP); Isao Suzuki, Mishima Shizuoka (JP); Keizaburo Yamamoto, Sunto Shizuoka (JP); Hiroyuki Kushida, Odawara Kanagawa (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 41 days.

(21) Appl. No.: 14/812,457

(22) Filed: Jul. 29, 2015

(65) Prior Publication Data

US 2016/0031213 A1 Feb. 4, 2016

(30) Foreign Application Priority Data

Jul. 30, 2014 (JP) ..... 2014-155518

(51) Int. Cl.

| | |
|---|---|
| ***B41J 2/045*** | (2006.01) |
| ***B41J 2/14*** | (2006.01) |
| ***B41J 2/16*** | (2006.01) |

(52) U.S. Cl.

CPC ..... *B41J 2/14201* (2013.01); *B41J 2/14209* (2013.01); *B41J 2/162* (2013.01); (Continued)

(58) Field of Classification Search

None

See application file for complete search history.

(56) References Cited

U.S. PATENT DOCUMENTS

| | | | |
|---|---|---|---|
| 5,604,521 | A | 2/1997 | Merkel et al. |
| 8,573,753 | B2 | 11/2013 | Shimosato |

(Continued)

FOREIGN PATENT DOCUMENTS

| | | | |
|---|---|---|---|
| JP | H04-353456 | A | 12/1992 |
| JP | H10-138472 | A | 5/1998 |

(Continued)

OTHER PUBLICATIONS

European Search Report issued on Dec. 1, 2015, mailed in counterpart European Application No. 15178759, pages.

*Primary Examiner* — Erica Lin

(74) *Attorney, Agent, or Firm* — Patterson & Sheridan, LLP

(57) ABSTRACT

An inkjet head includes a substrate, a piezoelectric unit disposed on the substrate and including a plurality of piezoelectric elements arranged along a surface of the substrate, and a plurality of pressure chambers, each of the pressure chambers being formed between two adjacent piezoelectric elements, a plurality of lid members, each of which is disposed on two adjacent piezoelectric elements and has a hole connected to one of the pressure chambers, and a nozzle plate disposed on the plurality of lid members and having a plurality of nozzles through which the liquid is discharged, each of the nozzles being connected to one of the holes of the lid members.

18 Claims, 7 Drawing Sheets

(52) U.S. Cl.
CPC ..... *B41J 2/1607* (2013.01); *B41J 2/1609* (2013.01); *B41J 2/1623* (2013.01); *B41J 2/1625* (2013.01); *B41J 2/1626* (2013.01); *B41J 2202/12* (2013.01)

(56) References Cited

U.S. PATENT DOCUMENTS

| | | | | |
|---|---|---|---|---|
| 2004/0263593 | A1* | 12/2004 | Harvey | B41J 2/1433 347/93 |
| 2006/0232641 | A1* | 10/2006 | Sugahara | B41J 2/14233 347/70 |
| 2010/0196602 | A1* | 8/2010 | Koyano | B41J 2/14129 427/256 |
| 2010/0238215 | A1 | 9/2010 | Kusunoki | |
| 2013/0050338 | A1* | 2/2013 | Shimosato | B41J 2/14209 347/40 |
| 2015/0283808 | A1 | 10/2015 | Shimosato et al. | |

FOREIGN PATENT DOCUMENTS

| | | | |
|---|---|---|---|
| JP | 2000-334954 | A | 12/2000 |
| JP | 2001246745 | A | 9/2001 |
| JP | 2002113861 | A | 4/2002 |
| JP | 2002137384 | A | 5/2002 |
| JP | 2002321361 | A | 11/2002 |
| JP | 2002-355960 | A | 12/2002 |
| WO | 9919147 | A1 | 4/1999 |
| WO | 0029217 | A1 | 5/2000 |
| WO | 0112442 | A2 | 2/2001 |
| WO | 03022585 | A1 | 3/2003 |

* cited by examiner

INKJET HEAD HAVING A PLURALITY OF LID MEMBERS CONNECTED TO NOZZLES AND AN INKJET APPARATUS HAVING THE INKJET HEAD

CROSS-REFERENCE TO RELATED APPLICATION

This application is based upon and claims the benefit of priority from Japanese Patent Application No. 2014-155518, filed Jul. 30, 2014, the entire contents of which are incorporated herein by reference.

FIELD

Embodiments described herein relate generally to an inkjet head and an inkjet apparatus.

BACKGROUND

An inkjet head of one type includes a plurality of piezoelectric elements arranged along a line and a plurality of pressure chambers, each arranged between two adjacent piezoelectric elements. In order to stabilize pressure of liquid in the pressure chambers and more reliably discharge the liquid in the pressure chambers, wall of the pressure chamber may be formed of a rigid material. To achieve such an objective, a lid member having a high rigidity may be bonded to the piezoelectric elements to form walls of the pressure chambers.

One method for bonding the lid member to the piezoelectric elements employs a thermosetting material. However, as the lid member has rigidity, an internal stress may remain in the piezoelectric elements after heat is applied for bonding and the thermosetting material is cooled off. When the piezoelectric elements are subjected to the internal stress, the liquid in the pressure chambers may not be properly discharged.

DETAILED DESCRIPTION

In general, according to one embodiment, an inkjet head includes a substrate, a piezoelectric unit disposed on the substrate and including a plurality of piezoelectric elements arranged along a surface of the substrate, and a plurality of pressure chambers, each of the pressure chambers being formed between two adjacent piezoelectric elements, a plurality of lid members, each of which is disposed on two adjacent piezoelectric elements and has a hole connected to one of the pressure chambers, and a nozzle plate disposed on the plurality of lid members and having a plurality of nozzles through which the liquid is discharged, each of the nozzles being connected to one of the holes of the lid members.

Figure 1:
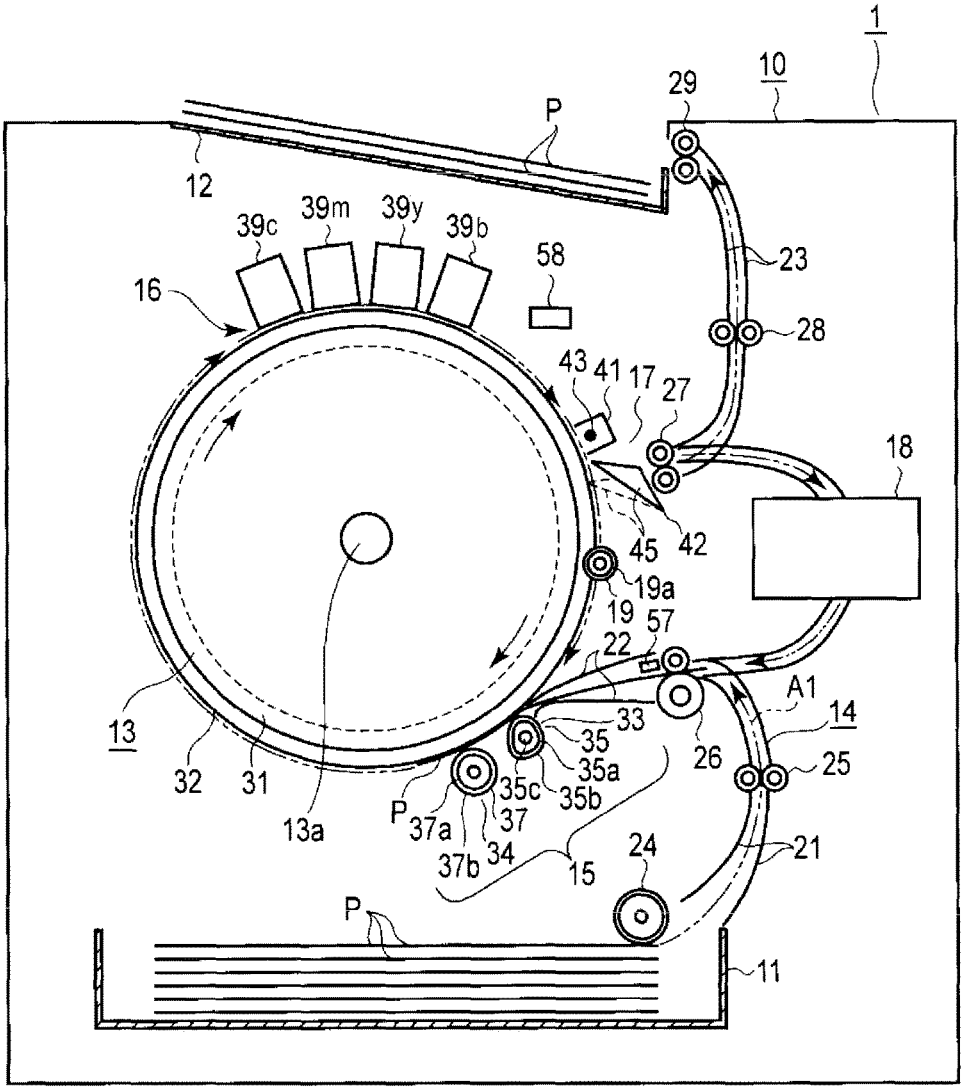
FIG. 1 schematically illustrates an inkjet apparatus according to an embodiment.

Hereinafter, an inkjet apparatus 1 according to an embodiment will be described with reference to the drawings. In the drawings, the related elements will be schematically shown by enlarging, reducing or omitting of the elements, if necessary. FIG. 1 schematically illustrates an inkjet apparatus 1 according to the present embodiment.

The inkjet apparatus 1 shown in FIG. 1 performs various kinds of processing such as image forming and transporting paper P, which is a recording medium. The inkjet apparatus 1 generally includes a housing 10, a paper cassette 11, a paper tray 12, a retention roller (drum) 13, a transport device 14, and a reversal device 18. The housing 10 configures the outer periphery of the inkjet apparatus 1. The paper cassette 11 is a paper storage unit section provided in the housing 10. The paper tray 12 is provided in the upper portion of the housing 10. The retention roller 13 rotates with paper P retained on the external surface thereof. The transport device 14 transports paper P along a predetermined transport path A1 which is formed from the paper cassette 11 to the paper tray 12 through the periphery of the retention roller 13. The reversal device 18 turns over papers, upside down, which are peeled off from the retention roller 13, and again conveys the reverse paper onto the surface of the retention roller 13.

The retention roller 13 has a retention device 15, an image forming device 16, an electricity discharging and peeling device 17, and a cleaning device 19 in order from an upstream side to a downstream side in a rotational direction of the retention roller. The retention device 15 pushes paper P against the external surface of the retention roller 13 such that the paper P adheres to and is retained on the surface (the peripheral surface) of the retention roller 13. The image forming device 16 forms images on the paper P retained on the external surface of the retention roller 13. The electricity discharging and peeling device 17 discharges electricity from the paper P and peels off the paper P from the retention roller 13. The cleaning device 19 cleans the surface of the retention roller 13.

The transport device 14 includes a plurality of guide members 21 to 23 and a plurality of transport rollers 24 to 29 provided along the transport path A1. The transport rollers include a pickup roller 24, a paper feeding roller pair 25, a register roller pair 26, a separation roller pair 27, a transport roller pair 28, a discharging roller pair 29. The transport rollers 24 to 29 are driven by a transport motor 71, and the paper P is transported to the downstream side along the transport path A1.

A paper position sensor 57 that detects a position of a tip end of the paper P is provided in the vicinity of a nip formed by the register roller pair 26 in the transport path A1. Further, an operation panel (not shown) in which various setting operations may be performed by a user is provided. Further, a temperature sensor 58 that detects temperature in an internal portion of the inkjet apparatus 1 is provided in the housing 10 of the inkjet apparatus 1. In addition, sensors or the like that monitor a transport state of paper are provided along the transport path A1.

The retention roller 13 includes a rotational shaft 13*a*, a cylindrical frame 31, and a thin insulation layer 32. The cylindrical frame 31 is formed of a conductive aluminum and has a cylindrical shape. The thin insulation layer 32 is formed on the surface of the cylindrical frame 31. Further, the retention roller 13 has a certain length in an axial direction. The cylindrical frame 31 is grounded, and is used as an opposite electrode so that the potential of the cylindrical frame 31 is maintained to be 0 V when a surface of the thin insulation layer 32 is electrified by an electrification roller 37. The retention roller 13 rotates with the paper P retained on the surface thereof so as to transport the paper P. Here, the retention roller 13 rotates clockwise with reference to FIG. 1 to transport the paper P in a clockwise direction along the periphery of the retention roller 13.

The retention device 15 includes a piezoelectric device 33 and an adsorption device 34. The piezoelectric device 33 pushes the paper P against the retention roller 13. The adsorption device 34 is disposed downstream with respect to the piezoelectric device 33 in the transporting direction of the paper P and causes the paper P to adhere to the retention roller 13 using an electrostatic force caused by electrification of piezoelectric device 33.

The piezoelectric device 33 includes a rotational shaft 35*c*, a push roller 35 (a push member), and a push motor (not shown). The push roller 35 is arranged to face the lower surface of the retention roller 13. The push motor drives the push roller 35.

The push roller 35 includes a cam in which the distance from the rotational shaft of the cam to the peripheral surface of the cam varies in plural steps. The push roller 35 is capable of switching among the first state, the second state, and the third state based on the rotational angle of the push roller 35. In the first state, the surface of the retention roller 13 is pushed with the first pushing force. In the second state, the surface of the retention roller 13 is pushed with the second pushing force which is weaker than the first pushing force. In the third state, the push roller 35 is separate from the retention roller 13, and thus no pushing force is applied to the retention roller 13 by the push roller 35.

The pressure applied to the retention roller 13 by the push roller 35 is set to be an appropriate value so that the paper P is not deformed and images on the paper P is not degraded. When the paper P passes through a nip formed between the retention roller 13 and the push roller 35, the push roller 35 presses the paper P against the retention roller 13, and thus the paper P is unwrinkled (stretched) and contacts the surface of the retention roller 13.

The peripheral surface of the push roller 35 is covered with an insulation layer 35*b* formed of insulation material so that electric charges in the electrified paper P is not discharged through the push roller 35.

The adsorption device 34 includes the electrification roller 37 which is disposed downstream with respect to the push roller 35 in the rotational direction of the retention roller 13. The electrification roller 37 includes a metallic electrification shaft 37*a* and a surface layer 37*b*. The metallic electrification shaft 37*a* extends in parallel to the rotational shaft 13*a* and is capable of being electrified. The surface layer 37*b* is formed in the periphery of the electrification shaft 37*a*. The electrification roller 37 is arranged to face the surface of the retention roller 13. Electrification of the electrification roller 37 may be controlled and the electrification roller 37 may be moved in the direction in which the electrification roller 37 towards and apart from the surface of the retention roller 13.

If electrical power is supplied to the electrification roller 37 when the electrification roller 37 is adjacent to the retention roller 13, as there is a potential difference between the electrification roller 37 and the grounded cylindrical frame 31, an electrostatic force is generated (electrified) in the direction in which the paper P is attracted to the retention roller 13. The electrostatic force causes the paper P to be attracted to the surface of the retention roller 13.

The image forming device 16 is arranged downstream with respect to the electrification roller 37 in the rotational direction of the retention roller 13, and includes a plurality of inkjet heads 39*c*, 39*m*, 39*y* and 39*b* which are arranged to face the upper portion of the surface of the retention roller 13. Here, the inkjet heads 39*c*, 39*m*, 39*y* and 39*b* of four colors such as cyan, magenta, yellow and black are provided respectively. The inkjet heads 39*c*, 39*m*, 39*y* and 39*b* of four colors discharge ink to the paper P from the nozzles which are provided at a predetermined pitch, and images are formed on the paper P with the discharged ink.

The electricity discharging and peeling device 17 includes an electricity discharging device 41 and a peeling device 42. The electricity discharging device 41 discharges electricity to the paper P. The peeling device 42 peels off the paper P from the surface of the retention roller 13 after the electricity is discharged.

The electricity discharging device 41 is provided downstream with respect to the image forming device 16 in the transport direction of paper, and includes an electricity discharging roller 43 which is capable of being electrified. The electricity discharging device 41 supplies electric charges to the paper P to peel off the paper P from the retention roller 13. As a result, an attractive force is released and the paper P may be easily peeled off from the retention roller 13.

The peeling device 42 is provided downstream with respect to the electricity discharging device 41 in the rotational direction of the retention roller 13, and includes a separation claw 45 which is configured to rotate (move). The separation claw 45 is capable of rotating between a peeling position where the separation claw is positioned between the paper P and the retention roller 13, and a retreating position where the separation claw retreats from the retention roller 13. When being arranged in the peeling position, the separation claw peels off the paper P from the surface of the retention roller 13. Further, in FIG. 1, the state where the separation claw is located in the peeling position is depicted by a broken line, and the state where the separation claw is located in the retreating position is depicted by a solid line.

The cleaning device 19 is provided downstream with respect to the electricity discharging and peeling device 17 in the rotational direction of the retention roller 13, and includes a cleaning member 19*a* and a cleaning motor (no shown). The cleaning member 19*a* is configured to move between a contacting position where the cleaning member 19*a* is in contact with the retention roller 13 and a separating position where the cleaning member 19*a* is apart from the retention roller 13. The cleaning motor drives the cleaning member 19*a*. In a state where the cleaning member 19*a* is in contact with the surface of the retention roller 13, the retention roller 13 rotates to cause the cleaning member 19*a* to perform cleaning of the surface of the retention roller 13.

The reversal device 18 is provided downstream with respect to the peeling device 42 in the rotational direction of the retention roller 13, and turns over the paper P peeled off by the peeling device 42 so as to convey the reversed paper P to the surface of the retention roller 13. The reversal device 18 guides and transports, for example, the paper P along a predetermined reversing path in which the paper P is reversed in the front and rear direction in the switchback manner, and thus the paper P is turned over.

Hereinafter, a configuration of the inkjet heads 39*c*, 39*m*, 39*y* and 39*b* of four colors in the image forming device 16 will be described. Since the configurations of the inkjet heads 39*c*, 39*m*, 39*y* and 39*b* of four colors are the same, a structure of an inkjet head 61, which corresponds to each of the inkjet head 39*c*, 39*m*, 39*y* and 39*b* will be described.

Figure 2:
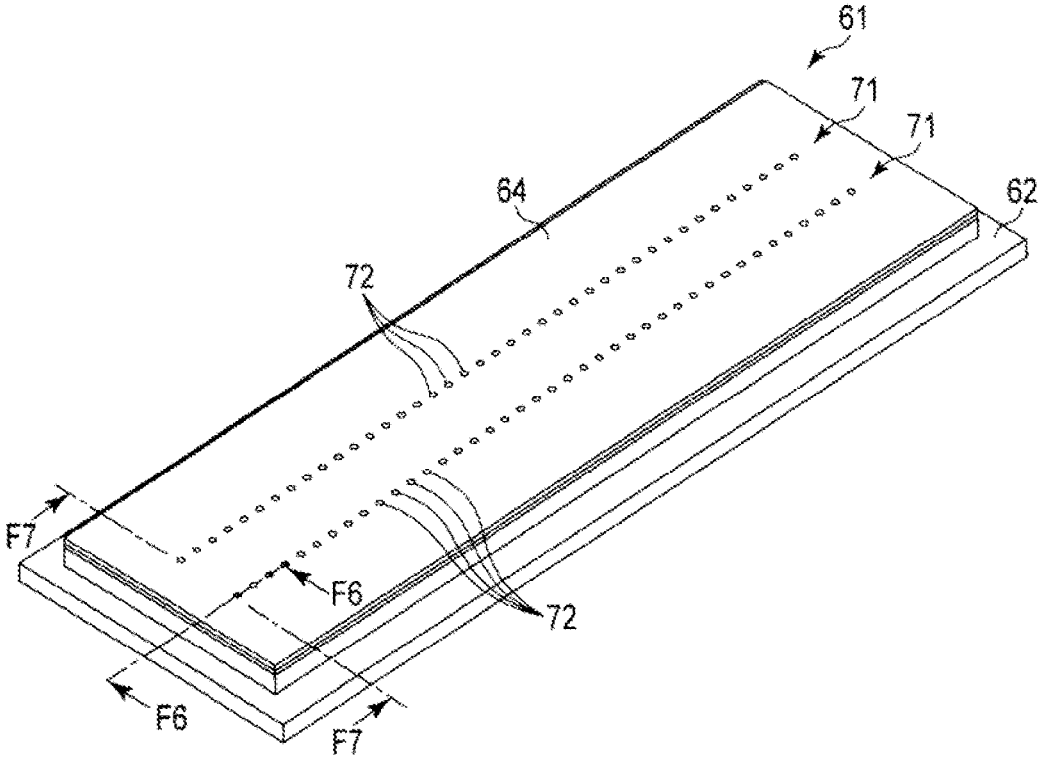
FIG. 2 is a perspective view of an inkjet head in the inkjet apparatus according to the embodiment.
Figure 3:
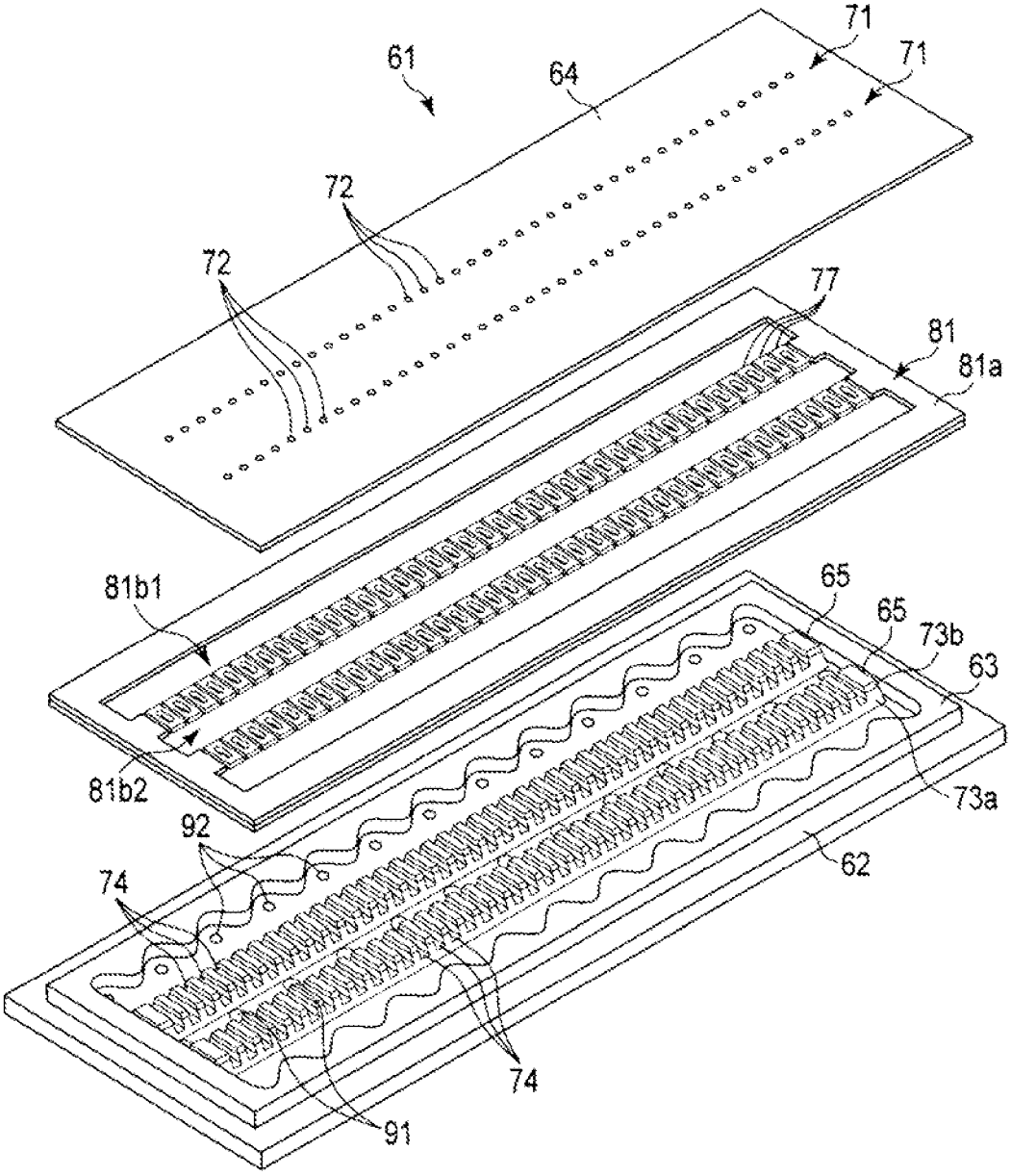
FIG. 3 is an exploded perspective view of the inkjet head.

FIG. 2 is a perspective view of the inkjet head 61 according to the first embodiment, and FIG. 3 is an exploded perspective view of the inkjet head 61. The inkjet head 61 is an inkjet head of a circulation type and a so called share mode share wall type, and has a structure referred to as a side shooter type. As shown in FIG. 2 and FIG. 3, the inkjet head 61 includes a substrate 62, a frame member 63, a nozzle plate 64, a pair of piezoelectric members 65, and a head driving IC (not shown).

The substrate 62 is formed of, for example, ceramics such as alumina and has a square planar shape. The substrate 62 includes a plurality of supplying ports 91 and a plurality of discharging ports 92 which are respectively a hole formed in the substrate 62. The supplying port 91 is connected to an ink tank (not shown) of a printer, and the discharging port 92 is connected to an ink tank (not shown).

The frame member 63 configures a part of a manifold, and is bonded to the substrate 62. The nozzle plate 64 is bonded to the frame member 63. The pair of piezoelectric members 65 is bonded to the substrate 62 in the frame member 63. The head driving IC is an electronic component that drives the piezoelectric members 65.

The nozzle plate 64 is formed of, for example, a resin material, such as polyimide, and is a film having a square shape having a thickness of 25 to 75 μm. The nozzle plate 64 includes a pair of nozzle rows 71. Each nozzle row 71 includes a plurality of nozzles 72.

Figure 6:
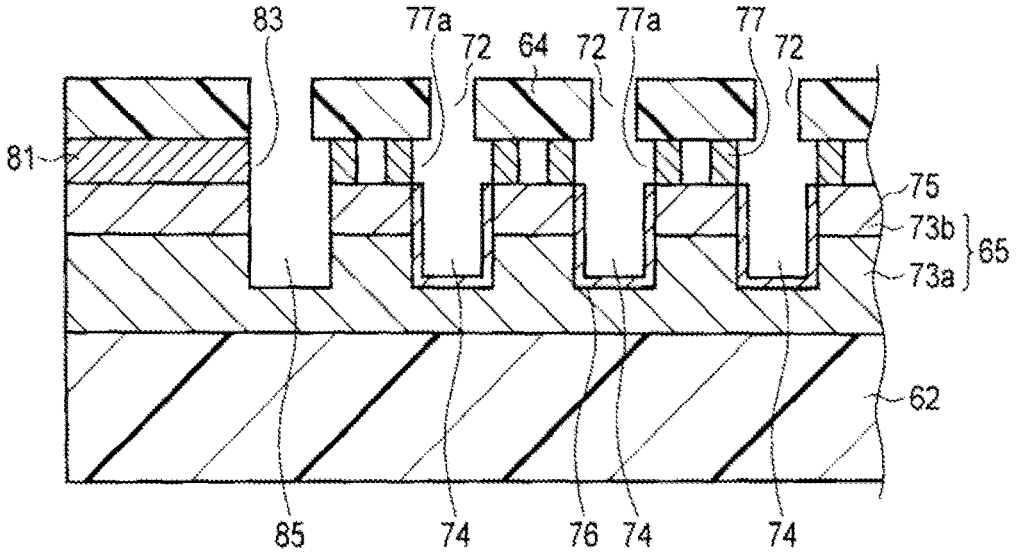
FIG. 6 is a cross-sectional view of the inkjet head taken along an F6-F6 line in FIG. 2.
Figure 7:
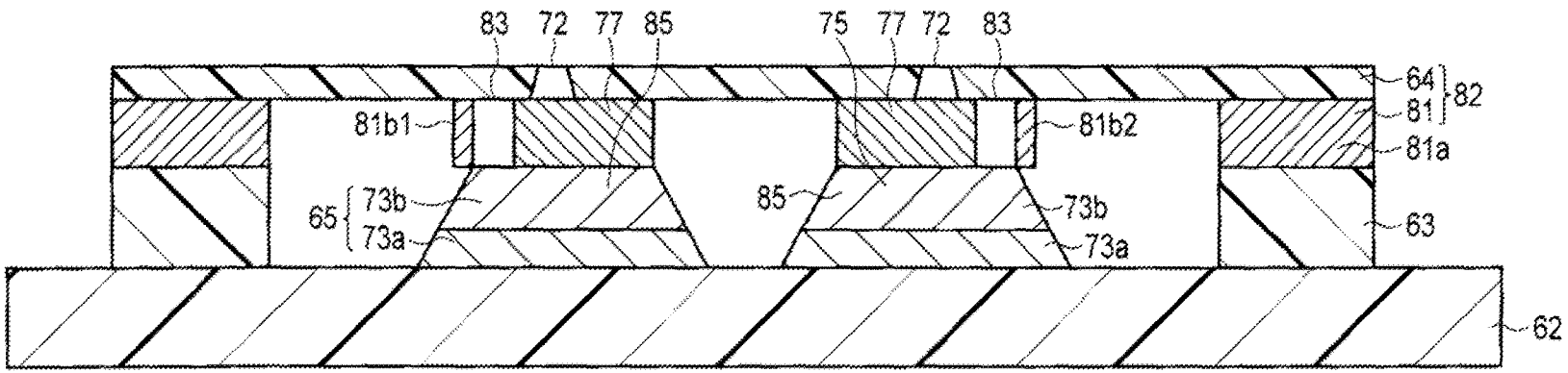
FIG. 7 is a cross-sectional view of the inkjet head taken along an F7-F7 line in FIG. 2.

As shown in FIG. 3 and FIG. 6, each of the piezoelectric members 65 is formed such that two piezoelectric plates of, for example, lead zirconate titanate (PZT) (a lower piezoelectric plate 73*a* and an upper piezoelectric plate 73*b*) are joined together so that the piezoelectric plates 73*a* and 73*b* have the opposite polarization directions to each other. As shown in FIG. 7, each piezoelectric member 65 has a rod-like shape extending in a longitudinal direction and a cross section thereof in a direction perpendicular to the longitudinal direction is a trapezoidal shape. Each piezoelectric member 65 includes a plurality of pillar sections 75 which function as a driving element and a plurality of electrodes 76 which are respectively formed in the side surfaces of the pillar sections 75 and bottoms of portions between adjacent pillar sections 75. The pressure chambers 74 are defined by the pillar sections 75 and the electrodes 76 and formed by cutting a surface of the piezoelectric member into groove-like shapes.

Further, when the inkjet head 61 operates, ink is supplied through the supplying port 91. In other words, the ink drawn out of the ink tank flows into the pressure chamber 74 through the supplying port 91, and as a result the pressure chamber is filled with the ink. The ink which is not used in the internal portion of the pressure chamber 74 is conveyed to the ink tank through the discharging port 92. The inkjet head 61 according to the present embodiment corresponds to a circulation type head, and circulates the ink in the internal portion of the pressure chamber so as to cause the mixed-in air bubbles and the like to be automatically removed.

Further, in the present embodiment, the nozzle plate 64 and a reinforcing plate are integrally coupled using, for example, thermal compression bonding, and configured as an integrated component 82. The reinforced plate 81 is formed of, for example, highly rigid materials such as metal, ceramic and the like. The reinforced plate 81 includes a frame body 81*a* of a rectangular shape and two lid rows 81*b*1 and 81*b*2 arranged in parallel to each other. The frame body 81*a* of the rectangular shape is formed to have a size corresponding to that of the frame member 63. The two lid rows 81*b*1 and 81*b*2 are arranged within the frame body 81*a* at a position where the two lid rows correspond to the pair of piezoelectric members 65.

Further, each of the two lid rows 81*b*1 and 81*b*2 has a plurality of lids 77. Each lid 77 is arranged at a position corresponding to one of the pressure chambers 74 formed in the piezoelectric member 65. According to this configuration, the number of the lids 77 is the same as the number of the pressure chambers 74 in the piezoelectric members 65. Further, each pressure chamber 74 has an opening which faces the nozzle plate 64 and is covered with the each lid 77. A communication hole 77*a* communicating with the nozzle 72 is formed in each lid 77. The communication hole 77*a* of each lid 77 has an opening area greater than the opening area of the nozzle 72. The pressure chamber 74 and the nozzle 72 communicate with each other through the communication hole 77*a* of the lid 77.

In the present embodiment, the integrated component 82 may be manufactured through the following process. First, a plate to be formed into the nozzle plate 64 and a plate to be formed into the reinforced plate 81 are subjected to a Roll-to-Roll process and bonded to each other, and as a result an integrated plate is prepared. Here, a machining apparatus that performs the Roll-to-Roll process includes a supplying roll and a winding roll. While a pre-processed plate (sheet material) unreeled from the supplying roll is wound around the winding roll, the sheet material is subjected to various processes. In the present embodiment, a resin material for forming the nozzle plate 64 and a material for forming the reinforced plate 81 are integrally coupled into one piece using the thermal compression, heat melting, and the like.

Figure 4:
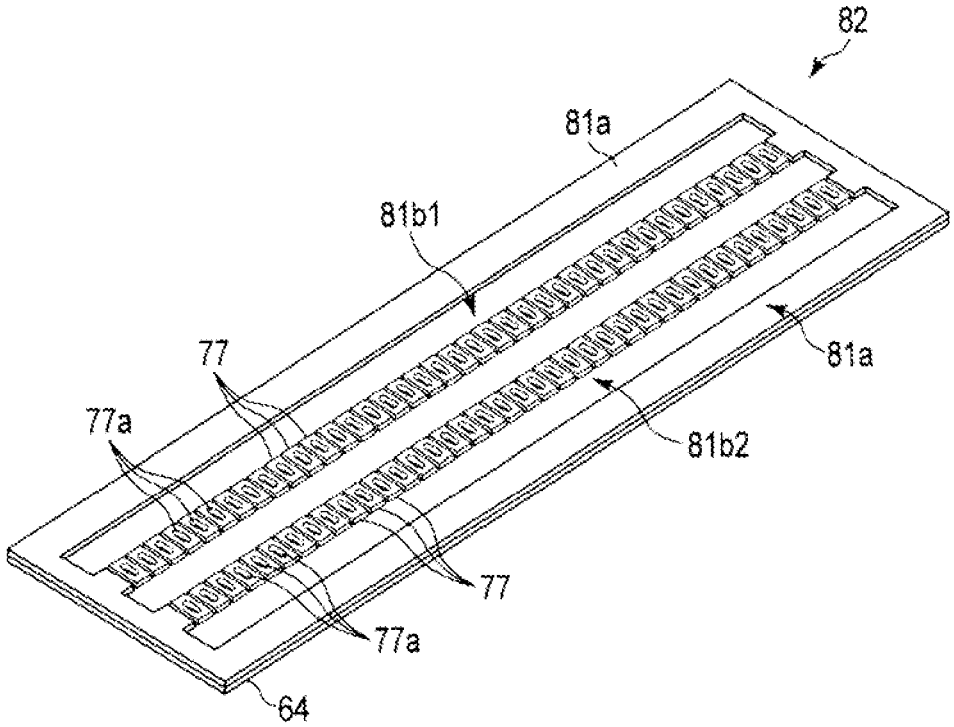
FIG. 4 is a perspective view of an integrated component of a nozzle plate and lids in the inkjet head.

Subsequently, the reinforced plate 81 of the integrated component 82 is subjected to an etching during the Roll-to-Roll process, and as a result the frame body 81*a* and the two lid rows 81*b*1 and 81*b*2 are simultaneously molded. During this process, as the etching is performed on the sheet material in a state where a certain tension is applied to the sheet material between the supplying roll and the winding roll, the etching process may be performed in high precision. After this process, the sheet material subjected to the etching process is cut into a plurality of pieces, each of which corresponds to the integrated one-piece component 82. FIG. 4 illustrates a structure produced by bonding the plate to be formed into the nozzle plate 64 and the plate to be formed into the reinforced plate 81, which is the sheet material, and patterning the bonded sheet material through the etching process.

A resin material used for the nozzle plate 64 of the integrated component 82 is, for example, polyimide, PET or the like. Here, the Young's modulus of the polyimide is 9 GPa, and the Young's modulus of the PET is 5 GPa. The metal used for the reinforced plate 81 is, for example, stainless, aluminum, copper, Kovar (a registered trade mark), 36 Ni—Fe, 42 Ni—Fe, 48 Ni—Fe, or the like. Here, the Young's modulus of each metal is as follows: stainless: 200 GPa, aluminum: 70 GPa, copper: 100 GPa, the Kovar: 130 GPa, 36 Ni—Fe: 140 GPa, 42 Ni—Fe: 150 GPa, and 48 Ni—Fe: 160 GPa.

Further, in the present embodiment, the reinforced plate 81 of the integrated component 82 is bonded to the frame member 63 and the pair of piezoelectric members 65 on the substrate 62. Specifically, the frame body 81*a* of the reinforced plate 81 is bonded to the frame member 63. The two lid rows 81*b*1 and 81*b*2 are boned to the pair of piezoelectric members 65. Each of the lids 77 is joined so as to correspond to one of the pressure chambers 74.

Figure 8:
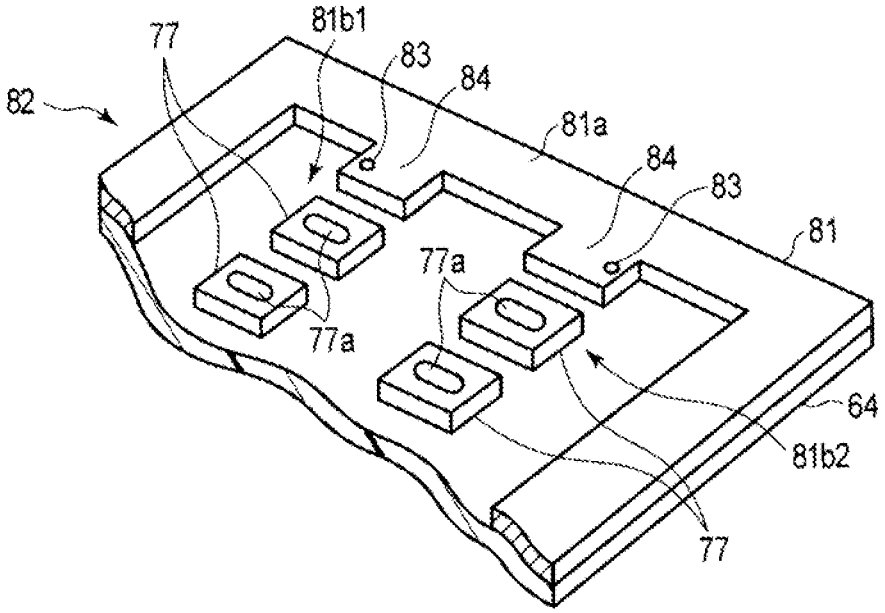
FIG. 8 is a perspective view of the lids coated through electroless plating.

As shown in FIG. 8, positioning holes 83 are respectively formed at both ends of the two lid rows 81*b*1 and 81*b*2 in the integrated component 82. The positioning holes 83 are formed in a bonding section 84 of the lid rows 81*b*1 and 81*b*2 and the frame body 81*a*. Further, dummy grooves 85 are formed in both ends of the pair of piezoelectric members 65 and the dummy grooves 85 are not capable of being used as the pressure chamber 74. The dummy groove 85 is formed to have the same shape as that of the pressure chamber 74 when the piezoelectric member 65 is molded. Further, since electrodes are not formed in a wall surface of the dummy grooves 85, the dummy grooves 85 normally remain in an unused state.

In the present embodiment, the dummy groove 85 of the piezoelectric member 65 is used for positioning the integrated component 82 relative to the piezoelectric member 65 when bonding the reinforced plate 81 of the integrated component 82 and the frame member 63 and the pair of piezoelectric members 65 on the substrate 62. In other words, during the bonding between the reinforced plate 81 of the integrated component 82 and the frame member 63 and the pair of piezoelectric members 65 on the substrate 62, the following positioning process is performed.

Figure 5:
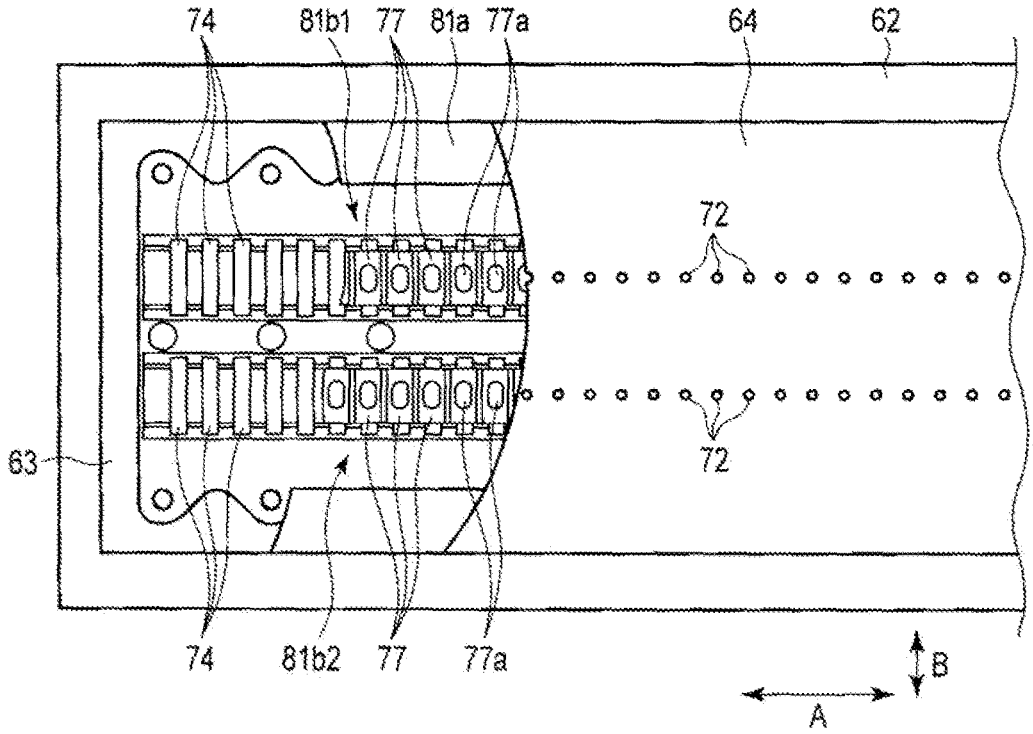
FIG. 5 is a partially transparent plan view of the inkjet head.

A microscope or the like is used for a worker to visually recognize the positioning hole 83 of the integrated component 82 and the dummy groove 85 of the piezoelectric member 65 and adjust the relative position of the positioning hole 83. In this process, the positional matching between the positioning hole 83 of the integrated component 82 and the dummy groove 85 of the piezoelectric member 65 is performed to position the piezoelectric member 65 in the longitudinal direction (arrow A direction in FIG. 5). Further, the positioning hole 83 of the integrated component 82 is used to perform the positional matching of corner portions in the peripheral walls of the dummy groove 85 to position the piezoelectric member 65 in the direction (the arrow B direction in FIG. 5) orthogonal to the longitudinal direction. After the positioning working, the bonding between the reinforced plate 81 of the integrated component 82 and the frame member 63 and the pair of piezoelectric members 65 on the substrate 62 is performed.

Further, the frame body 81*a* of the reinforced plate 81 is independent of the two lid rows 81*b*1 and 81*b*2, and is provided so that the worker can easily handle the reinforced plate 81. The frame body 81*a* may be unnecessary if the handling of the reinforced plate 81 is not difficult. However, since the existence or non-existence of the frame body 81*a* does not influence on workability during the etching process, the existence or non-existence of the frame body may be determined according to types of the head 61.

Hereinafter, an operation of the inkjet head 61 described above will be described. During the operation of the inkjet head 61 according to the present embodiment, if a user instructs a printer to perform printing, a control section of the printer outputs a print signal to the head driving IC in the inkjet head 61. The head driving IC which receives the print signal applies a driving pulse voltage to the pillar section 75 through an electric wiring. According to this configuration, a pair of left and right pillar sections 75 initially performs a share mode deformation and becomes separated from each other and deformed (curved) in an L-shape. In this case, the pressure chamber 74 is caused to decompress (expand). Subsequently, the pillar sections 75 return to the initial position to cause the pressure in the internal portion of the pressure chamber 74 to be increased (contract). According to this operation, the ink in the internal portion of the pressure chamber 74 reach the nozzle 72 of the nozzle plate 64 through the communication hole 77*a* of the lid 77, and then ink droplets are discharged from the nozzle 72.

In the inkjet head 61 according to the present embodiment, since the lid 77 configures the one wall surface of the pressure chamber 74, the lid 77 increases rigidity of the pressure chamber 74. The greater the rigidity of the lid 77 is (the stiffer/the thicker), the greater the rigidity of the pressure chamber 74 is. Therefore, the pressure generated by the piezoelectric member 65 may be efficiently used for discharging ink, the propagation velocity of the pressure in the ink also increases, and thus driving of the apparatus may be performed at a high speed.

According to the inkjet head 61 of the present embodiment, the lids 77 are disposed between the pair of piezoelectric members 65 and the nozzle plate 64. Each of the lids 77 is disposed correspond to one of the pressure chambers 74, and the lids 77 are formed of a highly rigid material of which the Young's modulus is higher than that of the nozzle plate 64. Further, each of the lids 77 has the communication hole 77*a* which communicates with the nozzle 72. Further, each of the lids 77 is individually and respectively provided. According to this configuration, the length of the bonding portion between each of the lids 77 and the piezoelectric member 65 become significantly shortened in comparison to a case where the entire pressure chambers 74 of the piezoelectric member 65 is covered with one lid member. In other words, the length of the bonding portion between each of the lids 77 and the piezoelectric member 65 would be approximately 1/the number of the pressure chambers 74 in comparison to the case where the entire pressure chambers 74 are covered with one lid member.

When the lids 77 and the piezoelectric members 65 are bonded with heat, according to a difference in the thermal expansion coefficient between the lids 77 and the piezoelectric members 65, a distortion may occur in the bonding portion between one pressure chamber 74 of the piezoelectric member 65 and one lid 77. If the distortion occurs, the resin material used for the nozzle plate 64 is elastically deformed so as to cancel the distortion of the one lid 77. As a result, residual stress generated in the piezoelectric chamber 65 caused by the bonding between one pressure chamber 74 of the piezoelectric member 65 and one lid 77 may be reduced. According to this configuration, the degrading of discharging characteristics in the inkjet head 61 may be suppressed.

Further, when the pair of piezoelectric members 65 and the reinforced plate 81 are bonded, each of the pressure chambers 74 may be individually and independently bonded to corresponding one of the lids 77. Therefore, without occurrence of positional shift, the highly precise inkjet head 61 may be formed.

Further, each of the lids 77 for a plurality of pressure chambers 74 is independently formed. Therefore, even if a conductive material is used to form the lids 77, electric short would not occur between two adjacent electrodes formed in the two adjacent pressure chambers 74. For this reason, each pressure chamber 74 does not need to be covered with an insulation coating. As metal is usually less expensive than ceramics, which is an insulating material, the inkjet head 61 may be manufactured at a lower cost by using the metal for the lids 77.

Further, metal used for the lids 77 may be selected according to types of ink or detergent to be used. By selecting an appropriate metal for the lids 77 or selecting an appropriate metal for covering (metal-plating) the lids 77, various types of ink or detergents can be used. For example, the surface of the metallic material of the lids 77 may be subjected to a nickel plating to form the nickel coating on the lids 77.

Further, in the present embodiment, when the integrated component 82 is manufactured, the etching of the nozzle plate and the reinforced plate 81 is performed during the Roll-to-Roll process, so that the lid 77 and the nozzle plate 64 may be integrally formed as one piece. In the etching process during the Roll-to-Roll process, the etching is performed in a state where a certain tension is applied to the sheet material between the supplying roll and the winding roll. For this reason, the etching process may be performed in high precision, the formed one-piece may be easily handled during the manufacturing of the head 61, and as a result a highly precise and low-cost head 61 may be manufactured.

Further, if a low thermal expansion alloy is used for the reinforced plate 81 of the integrated component 82, the residual stress in the piezoelectric member 65 may further decrease and as a result a head 61 having more excellent characteristics may be obtained. An alloy having a thermal expansion coefficient which approximates to a linear expansion coefficient of the piezoelectric member 65 may be selected as the low thermal expansion alloy. In other words, as the low thermal expansion alloy, "Kovar", 36-Ni alloy, 42-Ni alloy, 48-Ni alloy and the like may be selected. When an integrated structure of the nozzle plate 64 and the lids 77 are bonded with the piezoelectric members 65, each of the lids 77 is independently pressed during bonding. As distortion of the lids 77 generated due to a thermal process is autonomously absorbed by the nozzle plate 64 having flexibility, and thus positional shift of the lids 77 may be minimized.

Accordingly, in the present embodiment, when the lids 77 and the piezoelectric member 65 are bonded to each other, the residual stress generated in the piezoelectric member 65 may be decreased, and a highly precise and low-cost inkjet head and a highly precise and low-cost inkjet apparatus may be provided.

Modification Example

Figure 9:
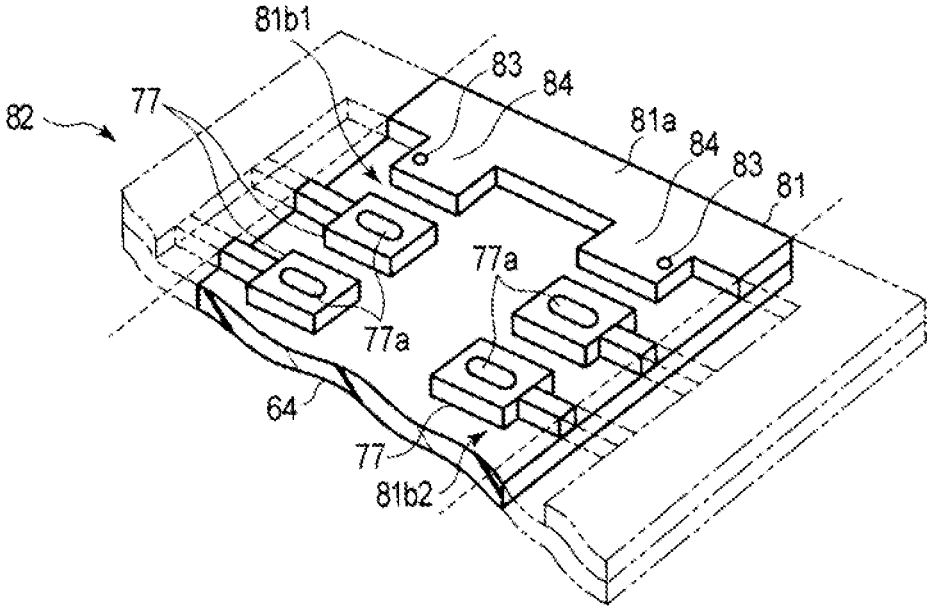
FIG. 9 is a perspective view of the lids coated through electrolytic plating.

When the material of the lids 77 according to the embodiment described above is subjected to metal plating, electroless plating may be used as shown in FIG. 8 or electrolytic plating may be used as shown in FIG. 9. When the electrolytic plating is used to perform molding, after the electrolytic plating is performed to form the plating coating, two side portions of the frame body 81*a* of the reinforced plate 81 may be cut as shown as the dotted line in FIG. 9, and only the frame body 81*a* may be used.

The embodiment is described as an inkjet apparatus. The inkjet apparatus may be a printer, such as a barcode printer or a receipt printer used for a POS system.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head comprising:

a substrate;

a piezoelectric unit disposed on the substrate and including a plurality of piezoelectric elements arranged along a surface of the substrate, and a plurality of pressure chambers, each of the pressure chambers being formed between two adjacent piezoelectric elements;

a plurality of lid members, each of which is disposed on two adjacent piezoelectric elements, has a first Young's modulus, and has a hole connected to one of the pressure chambers that is formed between the two adjacent piezoelectric elements on which the lid member is disposed; and a nozzle plate disposed on the plurality of lid members, having a second Young's modulus smaller than the first Young's modulus, and having a plurality of nozzles through which the liquid is discharged, each of the nozzles being connected to one of the holes of the lid members.

2. The inkjet head according to claim 1, wherein the plurality of lid members and the nozzle plate are integrally formed.

3. The inkjet head according to claim 1, wherein the nozzle plate is formed of polyimide.

4. The inkjet head according to claim 1, wherein at least a surface of the plurality of lid members is formed of metal.

5. The inkjet head according to claim 4, wherein the metal includes copper.

6. The inkjet head according to claim 4, wherein the surface of each of the lid members is formed of a nickel plating layer covering a base material thereof.

7. The inkjet head according to claim 1, further comprising:

a plurality of electrodes, each being formed on walls of one of the pressure chambers, wherein each of the lid members is not in contact with the electrode formed on the walls of the corresponding pressure chamber.

8. The inkjet head according to claim 1, wherein the plurality of lid members is not in contact with each other.

9. The inkjet head according to claim 1, wherein each of the piezoelectric elements extends in a direction perpendicular to the surface of the substrate, and each of the lid members extends in the direction perpendicular to the surface of the substrate.

10. The inkjet head according to claim 9, wherein each of the holes extends in the direction perpendicular to the surface of the substrate.

11. The inkjet head according to claim 1, wherein a width of each of the holes in a direction in which the piezoelectric elements are arranged is larger than a width of a corresponding one of the nozzles in the direction a width of a corresponding one of the pressure chambers in the direction.

12. The inkjet head according to claim 1, wherein the substrate has a plurality of inlets through which liquid is supplied into the pressure chambers, and a plurality of outlets through which the liquid is recovered from the pressure chambers.

13. An inkjet apparatus comprising:

a conveying unit configured to convey a medium; and an inkjet head configured to discharge liquid to the medium to form an image therewith, wherein the inkjet head includes:

a substrate;

a piezoelectric unit disposed on the substrate and including a plurality of piezoelectric elements arranged along a surface of the substrate, and a plurality of pressure chambers, each of the pressure chambers being formed between two adjacent piezoelectric elements;

a plurality of lid members, each of which is disposed on two adjacent piezoelectric elements, has a first Young's modulus, and has a hole connected to one of the pressure chambers that is formed between the two adjacent piezoelectric elements on which the lid member is disposed; and a nozzle plate disposed on the plurality of lid members, having a second Young's modulus smaller than the first Young's modulus, and having a plurality of nozzles through which the liquid is discharged, each of the nozzles being connected to one of the holes of the lid members.

14. The inkjet apparatus according to claim 13, wherein the plurality of lid members and the nozzle plate are integrally formed.

15. The inkjet apparatus according to claim 14, wherein the nozzle plate is formed of polyimide, and at least a surface of the plurality of lid members is formed of metal.

16. The inkjet apparatus according to claim 13, wherein the inkjet head further includes a plurality of electrodes, each being formed on walls of one of the pressure chambers, and each of the lid members is not in contact with the electrode formed on the walls of the corresponding pressure chamber.

17. The inkjet apparatus according to claim 13, wherein each of the piezoelectric elements extends in a direction perpendicular to the surface of the substrate, each of the lid members extends in the direction perpendicular to the surface of the substrate, and each of the holes extends in the direction perpendicular to the surface of the substrate.

18. The inkjet apparatus according to claim 13, further comprising:

a liquid reserve tank; and a circulator configured to circulate the liquid through the liquid reserve tank and the inkjet head, wherein the substrate has a plurality of inlets through which the liquid is supplied to the inkjet head from the liquid reserve tank, and a plurality of outlets through which the liquid is recovered from the inkjet head towards the liquid reserve tank.

* * * * *